US006666701B1

(12) United States Patent
Burkhardt et al.

(10) Patent No.: US 6,666,701 B1
(45) Date of Patent: Dec. 23, 2003

(54) BAYONET-TYPE ELECTRICAL CONNECTOR ASSEMBLY

(75) Inventors: Gert Burkhardt, Pasadena, CA (US); Mona-Lisa Alexander, San Marino, CA (US)

(73) Assignee: Signet Scientific Company, El Monte, CA (US)

( * ) Notice: Subject to any disclaimer, the term of this patent is extended or adjusted under 35 U.S.C. 154(b) by 0 days.

(21) Appl. No.: 10/201,414

(22) Filed: Jul. 22, 2002

(51) Int. Cl.[7] ..... H01R 13/62
(52) U.S. Cl. ..... 439/314; 439/321
(58) Field of Search ..... 439/314, 321, 439/318, 311, 320, 312, 313, 289

(56) References Cited

U.S. PATENT DOCUMENTS

| | | | | | |
|---|---|---|---|---|---|
| 3,824,681 | A | | 7/1974 | Clark | 29/593 |
| 4,477,022 | A | | 10/1984 | Shuey et al. | 339/59 M |
| 4,614,443 | A | | 9/1986 | Hamert | 374/163 |
| 4,707,046 | A | | 11/1987 | Strand | 439/314 |
| 5,093,593 | A | | 3/1992 | Philipp | 310/71 |
| 5,141,448 | A | | 8/1992 | Mattingly et al. | 439/314 |
| 5,145,394 | A | * | 9/1992 | Hager | 439/321 |
| 5,256,077 | A | | 10/1993 | Mattingly et al. | 439/314 |
| 5,383,272 | A | | 1/1995 | Mattingly et al. | 29/876 |
| 5,431,580 | A | * | 7/1995 | Tabata | 439/314 |
| 5,618,204 | A | | 4/1997 | Nix et al. | 439/559 |
| 5,662,488 | A | * | 9/1997 | Alden | 439/314 |
| 6,183,293 | B1 | | 2/2001 | Kieninger | 439/551 |
| 6,226,068 | B1 | | 5/2001 | Arcykiewicz et al. | 349/314 |
| 6,386,897 | B1 | | 5/2002 | Muller | 439/314 |

* cited by examiner

*Primary Examiner*—Renee Luebke
*Assistant Examiner*—Felix O. Figueroa
(74) *Attorney, Agent, or Firm*—Sheppard, Mullin, Richter & Hampton LLP

(57) ABSTRACT

A bayonet-type connector assembly for releasably securing a first connector half to a second connector half along a connection axis by simple rotation of a bayonet nut. Each connector half includes a plurality of electrical contacts. The bayonet nut encircles the second connector half. Rotation of the nut to a closed position causes a thread segment on the nut to engage corresponding grooved segments formed in the first connector half, to mate the connector halves, enabling electrical contact between the connector halves. Rotation of the bayonet nut also slides a slidable portion, i.e., a nut cam, beneath a cam of the second connector half to prevent axial separation of the two connector halves. The connector assembly further includes a detent positioned to engage a securement on one of the cams to releasably lock the nut in the closed position.

18 Claims, 3 Drawing Sheets

BAYONET-TYPE ELECTRICAL CONNECTOR ASSEMBLY

FIELD OF THE INVENTION

The present invention relates generally to electrical connectors and, more particularly, to bayonet-type electrical connectors assemblies.

BACKGROUND OF THE INVENTION

The need to provide electrical contact between detachable components is well known. Electrical connectors employed for such a purpose commonly include two connector halves held by a connector nut. Such connectors have been used in many applications, such as providing a contact between a detachable sensor and an electronics housing. Detachable sensor assemblies are used in a variety of industrial applications, many exposing the sensor assembly to harsh environments, e.g., substantial vibrations, fluids and excessive contact force.

Such industrial applications have proven to induce malfunctions in prior connector assemblies. For example, excessive vibrations can dislodge the connector halves from one another, i.e., axial separation, causing a break in electrical contact. Also, repeated coupling and uncoupling of electrical connector halves, such as those using pin-type connectors, can cause damage to the connectors, particularly, where inadequate care is taken by maintenance personnel. Thus, it is beneficial to provide an electrical connection that not only establishes a reliable electrical connection but also establishes a sturdy mechanical connection of the connector halves.

It should, therefore, be appreciated that there is a need for a bayonet-type connector assembly that provides a rugged and reliable mechanism for releasably securing a first connector half to a second connector half, useable in a variety of applications such as securing a detachable sensor to an electronic housing. The present invention fulfills this need as well as others.

SUMMARY OF THE INVENTION

The present invention provides a bayonet-type connector assembly for releasably securing a first connector half to a second connector half along a connection axis by simple rotation of a bayonet nut. Each connector half includes a plurality of electrical contacts. The bayonet nut encircles the second connector half. Rotation of the nut to a closed position causes a thread segment on the nut to engage a corresponding grooved segment of the first connector half, to mate the connector halves, enabling electrical contact between the connector halves. Rotation of the bayonet nut also slides a slidable portion, i.e., a nut cam, beneath a cam of the second connector half to prevent axial separation of the two connector halves. The connector assembly further includes a detent positioned to engage a securement on one of the cams to releasably lock the nut in the closed position. The connector assembly is particularly effective in applications where a risk of inadvertent axial separation of connector halves exists. Moreover, all of the parts can be manufactured by simple, relatively inexpensive injection molding techniques.

In a detailed aspect of preferred embodiments of the invention, the second connector half further includes a second cam disposed adjacent to the opening of the cavity. The second cam is oriented generally perpendicular to the connection axis and is spaced apart from the first cam of the second connector half. The nut further includes a second cam configured to cooperate with the second cam of the second connector half, to prevent axial separation of the connector halves. The nut further has an open position within 70 degrees of rotation from the closed position for receiving the first connector half. Thus, the nut inhibits connecting the electrical contacts of the first and second connector halves without rotating the nut from the open position to the closed position.

In another detailed aspect of preferred embodiments of the invention, the electrical contacts of the second connector half are pogo-style pin contacts and the electrical contacts of the first connector are planar contacts oriented perpendicular to the contacts of the second connector. The spring forces of the pogo-style pins aid in maintaining a positive connection between the contacts.

In yet another detailed aspect of a preferred embodiment of the invention, the detent is a deflectable finger positioned adjacent to a trailing edge of the cam of the second connector half and the securement is a depression defined by the cam of the nut adjacent to a trailing edge thereof.

In a preferred embodiment of the invention, the first connector half includes an O-ring mounted to contact the second connector half within the cavity and to provide a fluid-resistant seal.

Other features and advantages of the invention should become apparent from the following description of the preferred embodiments, taken in conjunction with the accompanying drawings, which illustrate, by way of example, the principles of the invention.

BRIEF DESCRIPTION OF THE DRAWINGS

Embodiments of the present invention will now be described, by way of example only, with reference to the following drawings in which.

DESCRIPTION OF THE PREFERRED EMBODIMENTS

Figure 1:
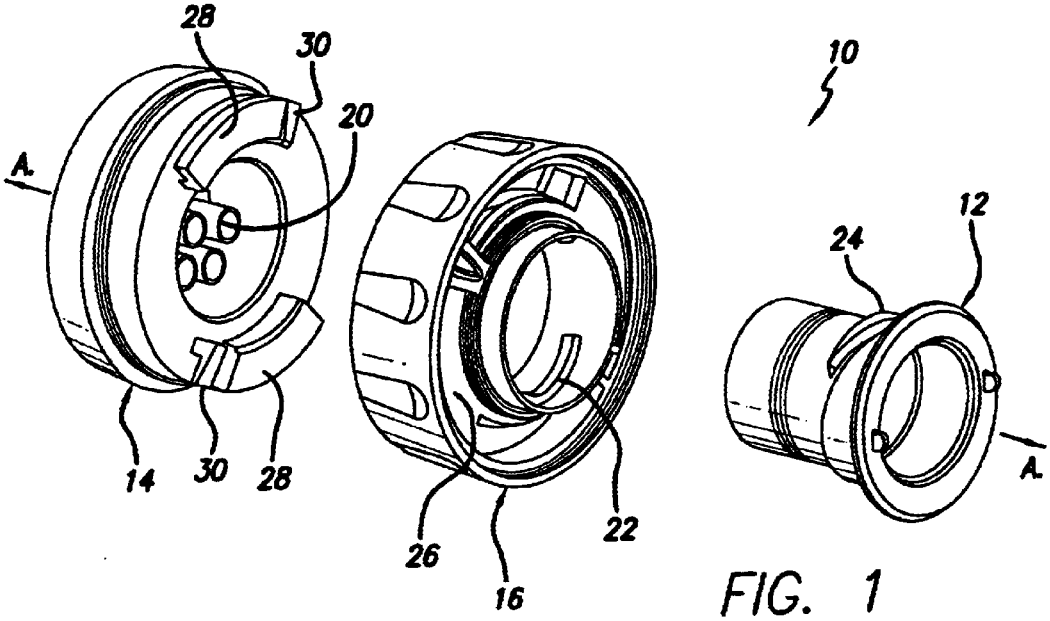
FIG. 1 is an exploded perspective view of a preferred embodiment of a bayonet-type connector assembly in accordance with the invention, the connector assembly including a first connector half, a second connector half, and a bayonet nut.

With reference to the illustrative drawings, and particularly to FIG. 1, there is shown a bayonet-type connector assembly 10 having a first connector half 12, a second connector half 14, and a bayonet nut 16. The first and second connector halves include electrical contacts 18 (FIG. 3), 20, respectively. The bayonet nut encircles the second connector half. Rotation of the nut to a closed position causes two short thread segments 22 on the nut to engage corresponding grooved segments 24 formed in the first connector half, to mate the connector halves along a connection axis (A—A), enabling electrical contact between the connector halves. Rotation of the bayonet nut also slides two slidable portions, i.e., nut cams 26, beneath a corresponding pair of cams 28 of the second connector half. This prevents axial separation of the two connector halves. The connector assembly further includes detents, i.e., deflectable fingers 30, each positioned to engage a corresponding depression 32 (FIG. 5) formed by the nut cams. Once engaged, the detents releasably lock the nut in its closed position. The connector assembly is particularly effective in applications where a risk of inadvertent axial separation of connector halves exists. Moreover, all of the parts can be manufactured by simple, relatively inexpensive injection molding techniques, and the connector assembly provides additional safety-related and economic benefits, as will be described below.

Figure 2:
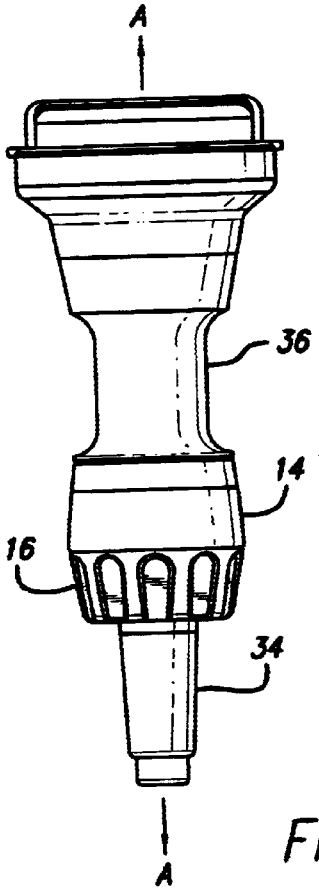
FIG. 2 is an elevational view of an electrical housing and detachable sensor incorporating the connector assembly of FIG. 1.

With reference to FIG. 2, the connector assembly 10 is shown beneficially employed in securing a detachable sensor 34 to an electronics housing 36. In this embodiment, the second connector half 14 is positioned at a bottom portion of the electronics housing and the first connector half 12 is positioned at an upper portion of the sensor (not shown). The connector assembly provides a sturdy mechanical connection of the connector halves, thereby minimizing the risk that excessive vibrations will dislodge the connector halves from one another, causing a break in electrical contact. Moreover, the connector assembly provides a smooth mating action of the connector halves, minimizing the risk of damage to the contacts 18, 20, even where appropriate care is not taken by maintenance personnel. The first connector half includes an O-ring 38 (FIG. 3) positioned to form a fluid-resistant seal with the second connector half, thereby reducing a risk of fluid exposure at the interface of the connector halves. Thus, the connector assembly provides reliable electrical and mechanical connections, even in harsh environments.

Figure 3:
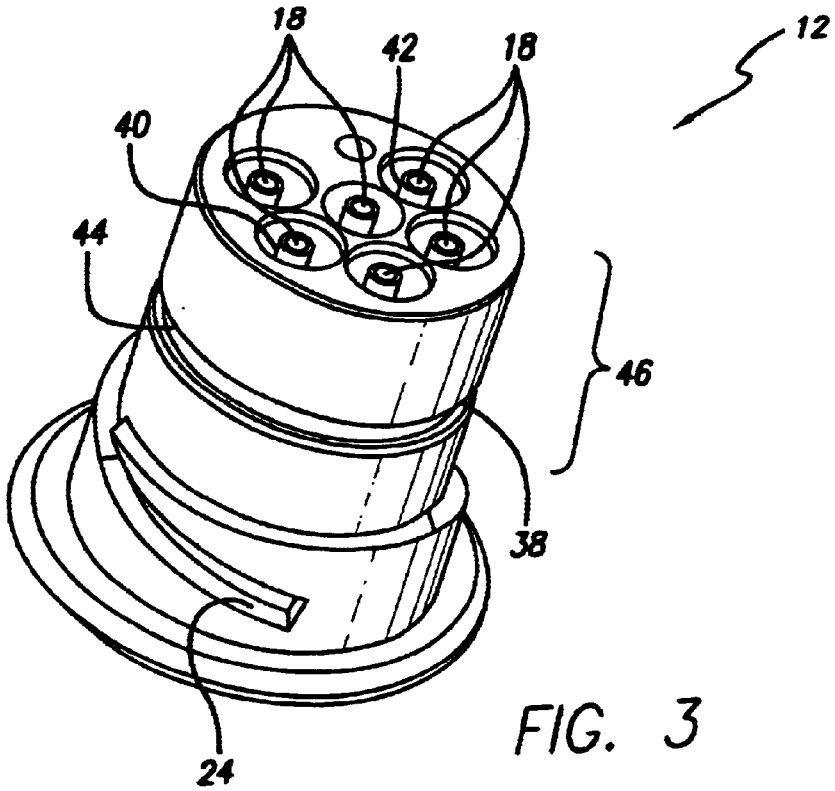
FIG. 3 is a perspective view of the first connector half of the connector assembly of FIG. 1.

With reference to FIG. 3, the first connector half 12 is generally cylindrical and has six electrical contacts 18. Each contact is positioned within a contact recess 40 and terminates in a relatively small circular plate positioned atop a post 42 within the corresponding contract recess. The contact recesses are configured cooperate with the second connector half 14 to allow contact between the electrical contacts 18, 20. The O-ring 38 is positioned within a channel 44 encircling an upper portion 46 of the first connector half. It provides a fluid-resistant seal within the cavity of the second connector half, once mated. The grooved segments 24 are positioned below the O-ring with respect to the six contacts.

Figure 4:
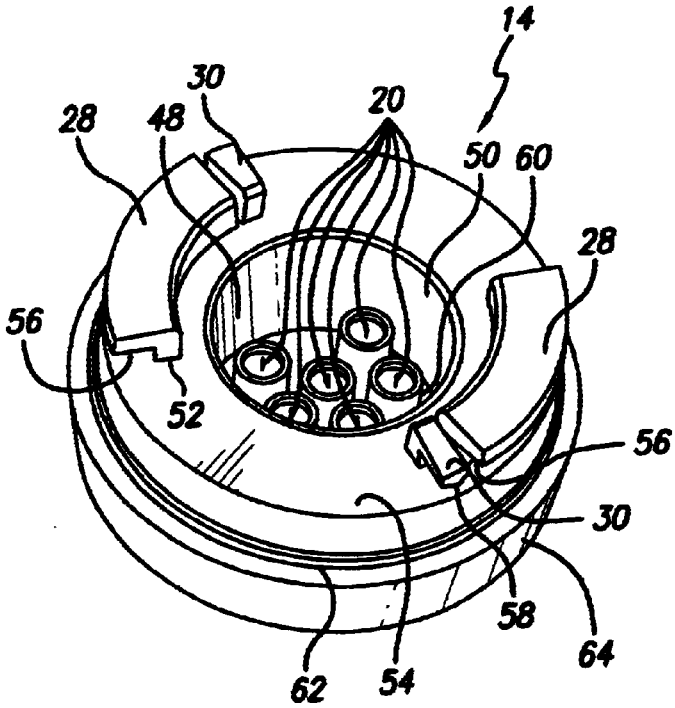
FIG. 4 is a perspective view of the second connector half of the connector assembly of FIG. 1.

With reference now to FIG. 4, the second connector half 14 is generally cylindrical and defines a cavity 48 having an opening 50. The cavity is configured to receive the upper portion 46 (FIG. 3) of the first connector half 12. The cams 28 of the second connector half are generally arc-shaped, outwardly cantilevered ledges extending from upstanding portions 52 and are positioned on opposite sides of the cavity opening, generally perpendicular to the connection axis (A—A). The cams of the second connector half and an upper surface 54 define recesses 56 for receiving the nut cams 30. When the nut 16 is rotated to its closed position, the nut cams slide into the recesses 56, clamping the nut to the second connector half. In the closed position, the cams inhibit axial separation of the connector halves. Although in this embodiment the cams are configured as cantilevered ledges, it will be appreciated that they can have alternate configurations without departing from the invention, so long as the cams cooperate to prevent axial separation of the connector halves.

The deflectable fingers 30 are adjacent to the cams 28 of the second connector half Each deflectable finger extends from the upper surface 54 and defines a lower curved portion 58. The curved portions are configured to be securely received by the corresponding depressions 32 (FIG. 5) of the nut 16. Once the nut has been rotated to the closed position, the curved portions are disposed within the depressions, securing the nut in the closed position. The fingers and the depressions are configured to maintain the nut in the closed position in the face of various forces, e.g., equipment vibration and incidental contact.

The electrical contacts 20 of second connector half 14 are configured as six spring-loaded connector pins, i.e., pogo-style pins, and are each located within a protective support 60 disposed within the cavity 48. The protective supports are cylindrical, each encircling a corresponding pogo-style pin and extending above the height of the pin. The protective supports are sized and aligned to be received within contact recesses 40 (FIG. 3) defined in the first connector half 12. The spring forces of the pogo-style pins aid in providing positive contact pressure between the electrical contacts 18, 20 of the connector halves, ensuring electrical contact.

With continued reference to FIG. 4, the second connector half 14 further includes a circular rib 62 extended around its outer periphery. The rib enables a snap fit with the bayonet nut 16 as described further below. The second connector half also includes a stepped portion 64 positioned below the rib with respect to the opening 50. The stepped portion provides a smooth and aesthetic transition between the second connector half and the bayonet nut, as shown in FIG. 2.

Figure 5:
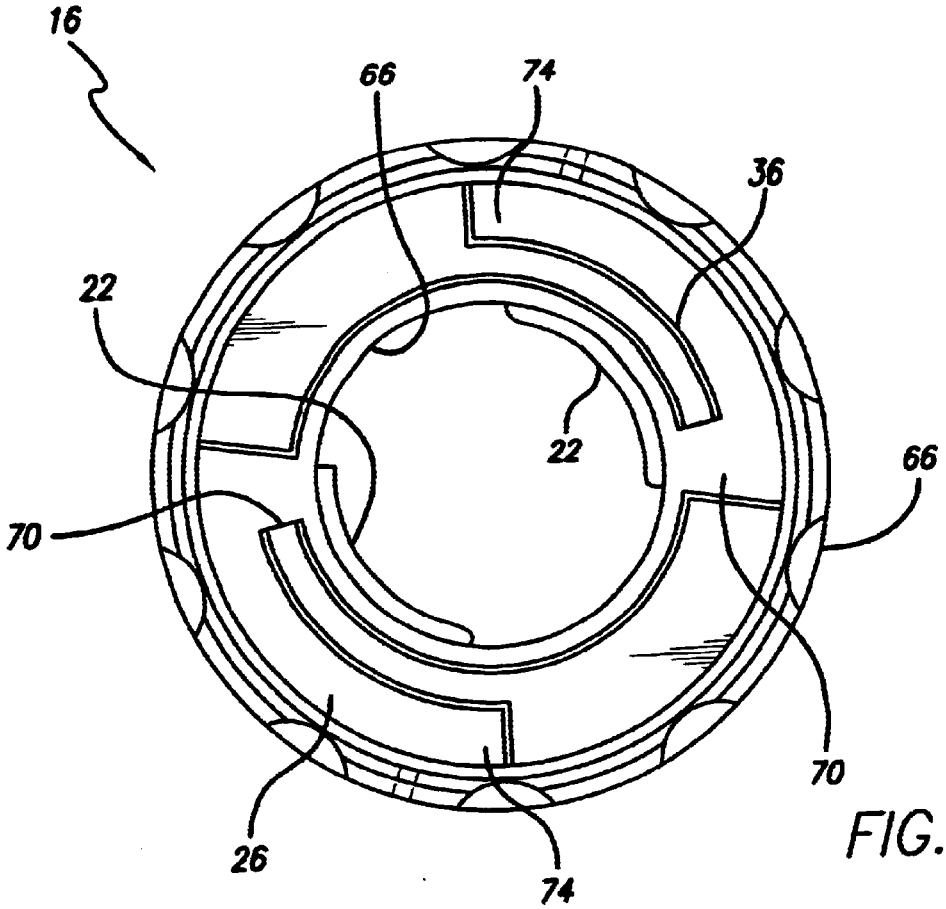
FIG. 5 is a plan view of the bayonet nut of the connector assembly of FIG. 1.
Figure 6:
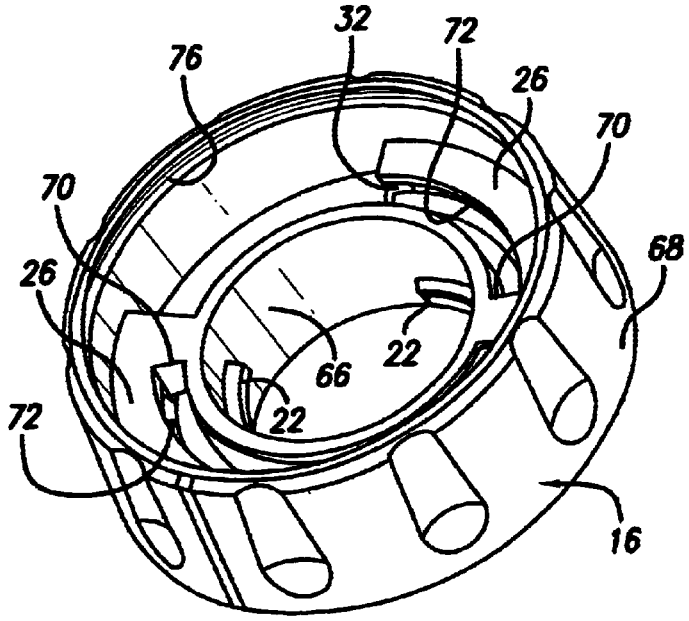
FIG. 6 is a perspective view of the bayonet nut of the connector assembly of FIG. 1.

With reference now to FIGS. 5 and 6, the bayonet nut 16 includes an inner cylinder 66 and an outer grip 68 encircling the inner cylinder. The inner cylinder is configured to allow the first connector half to extend through and mate with the second connector half, once the nut is in its closed position. The thread segments 22 are positioned on the inner surface of the cylinder to engage the grooved segment 24 of the first connector half. The thread segments and the grooved segments cooperatively provide about 70 degrees of rotation from an open position for receiving the first connector half to the closed position.

The nut cams 26 are positioned between the inner cylinder 66 and the outer grip 68 and are oriented generally parallel to the cams 28 of the second connector half 14. The nut cams cooperate with the cams of the second connector half to prevent axial separation of the connector halves when the nut is in its closed position. The nut cams are configured as arc-shaped ledges inwardly cantilevered from the outer grip. In the open position, the nut cams sit next to the cams of the second connector half. In use, the operator rotates the nut from the open to the closed position, causing the nut cams to slide beneath the cams of the second connector half, interlocking the two sets of cams. Once the closed position is reached, the detents 30 are releasably locked within the depressions 32 and the cams of the second connector half sit next to walls 70. Each depression is located on a slidable surface 72 adjacent to a leading edge 74 of its respective nut cam.

With continued reference to FIGS. 5 and 6, the bayonet nut 16 includes a circular recess 76 configured to cooperate with the circular rib 62 of second connector half 12 for attaching the nut to the second connector half. The circular recess receives the rib by axially snapping the nut onto the first connector half. This snap fit allows rotation of the nut between its open and closed positions, while maintaining the nut's axial relationship with the housing. When snapping the nut to the housing, the nut cams 26 and the cams 28 of the second connector half must be properly aligned. The nut cams are sufficiently spaced within the region between the cylinder 66 the outer grip 68 to allow the cams of the second connector half to extend therein.

It should be appreciated from the foregoing description that the present invention provides a connector assembly with a rugged and reliable mechanism for releasably securing a first connector half to a second connector half, by rotation of a bayonet nut. The connector assembly is particularly effective in applications where a risk of inadvertent axial separation of connector halves exists. Moreover, the connector assembly is cost-effective to manufacture, operate and maintain.

The foregoing detailed description of the present invention is provided for the purposes of illustration and is not intended to be exhaustive or to limit the invention to the precise embodiments disclosed. Accordingly, the scope of the present invention is defined by the following claims.

We claim:

1. A bayonet-type connector assembly configured to mate with a first connector half having a generally cylindrical shape and including a plurality of electrical contacts and a grooved segment defined in a side wall, comprising:

a second connector half defining a cavity for receiving the first connector half along a connection axis defined between the first and second connector halves, the second connector half including a plurality of electrical contacts disposed within the cavity and configured to provide electrical contact with the plurality of electrical contacts of the first connector half, an arc-shaped cam disposed adjacent to an opening of the cavity and oriented generally perpendicular to the connection axis; and a bayonet nut positioned about the second connector half, rotatable to a closed position for mating the connector halves, the bayonet nut including an inner cylinder having an inner surface configured to allow the first connector half to extend therethrough, an outer grip encircling the inner cylinder, a thread segment positioned on the inner surface of the inner cylinder to engage the grooved segment of the first connector half, to drive the first connector half toward the second connector half, and an arc-shaped cam positioned between the inner cylinder and the outer grip, oriented generally parallel to and configured to cooperate with the arc-shaped cam of the second connector half to prevent axial separation of the first and second connector halves when the nut is in the closed position; and a detent configured to engage a securement on one of the cams to releasably lock the nut in the closed position.

2. A connector assembly as defined in claim 1, wherein the electrical contacts of the second connector are pogo-style pin contacts and the electrical contacts of the first connector are planar contacts oriented perpendicular to the contacts of the first connector.

3. A connector assembly as defined in claim 1, wherein the bayonet nut further has an open position within 70 degrees of rotation from the closed position for receiving the first connector half, wherein further the bayonet nut inhibits contact between the electrical contacts of the first and second connector halves without rotating the nut from the open position to the closed position.

4. A connector assembly as defined in claim 1, wherein:

the second connector half further includes a second arc-shaped cam disposed adjacent to the opening of the cavity, oriented generally perpendicular to the connection axis, and spaced apart from the first cam of the second connector half, and the nut further includes a second arc-shaped cam configured to cooperate with the second cam of the second connector half, to prevent axial separation of the first and second connector halves.

5. A connector assembly as defined in claim 1, wherein the detent is a deflectable finger positioned adjacent to a trailing edge of the cam of the second connector half and the securement is a depression defined by the cam of the nut adjacent to a leading edge thereof.

6. A connector assembly as defined in claim 1, wherein the cavity of the second connector half is configured to provide a fluid-resistant seal with the first connector half, the first connector half having an O-ring mounted to contact the second connector half within the cavity.

7. A bayonet-type connector assembly comprising:

a first connector half having a generally cylindrical shape and including a plurality of electrical contacts and a grooved segment defined in a side wall;

a second connector half defining a cavity for receiving the second connector half along a connection axis defined between the first and second connector halves, the second connector half including a plurality of electrical contacts disposed within the cavity and configured to provide electrical contact with the plurality of electrical contacts of the first connector half, a plurality of arc-shaped cams disposed adjacent to and spaced about an opening of the cavity and oriented generally perpendicular to the connection axis; and a bayonet nut positioned about the second connector half, rotatable to a closed position for mating the connector halves, including an inner cylinder, having an inner surface, configured to allow the first connector half to extend therethrough, an outer grip encircling the inner cylinder, a thread segment positioned on the inner surface of the inner cylinder to engage the grooved segment of the first connector half, to drive the first connector half toward the second connector half, and a plurality of arc-shaped cams positioned between the inner cylinder and the outer grip, oriented generally parallel to and configured to cooperate with the plurality of arc-shaped cams of the second connector half to prevent axial separation of the first and second connector halves when the nut is in the closed position; and a detent configured to engage a securement on one of the cams to releasably lock the nut in the closed position.

8. A connector assembly as defined in claim 7, wherein the electrical contacts of the second connector are pogo-style pin contacts and the electrical contacts of the first connector are planar contacts oriented perpendicular to the contacts of the second connector.

9. A connector assembly as defined in claim 7, wherein the bayonet nut further has an open position within 70 degrees of rotation from the closed position for receiving the first connector half, wherein further the bayonet nut inhibits contact between the electrical contacts of the first and second connector halves without rotating the nut from the open position to the closed position.

10. A connector assembly as defined in claim 7, wherein the detent is a deflectable finger positioned adjacent to a trailing edge of the cam of the first connector half and the securement is a depression defined by the cam of the nut adjacent to a trailing edge thereof.

11. A connector assembly as defined in claim 7, wherein the cavity of the second connector half is configured to provide a fluid-resistant seal with the first connector half, the first connector half having an O-ring mounted to contact the second connector half within the cavity.

12. A bayonet-type connector assembly for use with an electrical housing and a detachable sensor, comprising:

a sensor connector half having a generally cylindrical shape, including a plurality of electrical contacts disposed at a first end and a grooved segment defined in a side wall, a housing connector half defining a cavity for receiving a sensor connector half, the housing connector half including a plurality of electrical contacts disposed within the cavity and configured to provide electrical contact with the plurality of electrical contacts of the sensor connector half, an arc-shaped cam disposed adjacent to an opening of the cavity and oriented generally perpendicular to a connection axis defined between the sensor and the housing connector halves; and a bayonet nut positioned about the housing half, rotatable to a closed position for mating the connector halves, including an inner cylinder, having an inner surface, configured to allow the sensor half to extend therethrough, an outer grip encircling the inner cylinder, a thread segment positioned on the inner surface of the inner cylinder to engage the grooved segment of the sensor half, to drive the sensor half toward the housing half, and an arc-shaped cam positioned between the inner cylinder and the outer grip, oriented generally parallel to and configured to cooperate with the arc-shaped cam of the housing half to prevent axial separation of the sensor and housing connector halves when the nut is in the closed position; and a detent configured to engage a securement on one of the cams to releasably lock the nut in the closed position.

13. A connector assembly as defined in claim 12, wherein the electrical contacts of the housing connector are pogo-style pin contacts and the electrical contacts of the sensor connector are planar contacts oriented perpendicular to the contacts of the housing connector.

14. A connector assembly as defined in claim 12, wherein the bayonet nut further has an open position within 70 degrees of rotation from the closed position for receiving the sensor connector half, wherein further the bayonet nut inhibits contact between the electrical contacts of the housing and sensor connector halves without rotating the nut from the open position to the closed position.

15. A connector assembly as defined in claim 12, wherein:

the housing connector half further includes a sensor arc-shaped cam disposed adjacent to an opening of the cavity, oriented generally perpendicular to the connection axis, and spaced apart from the first cam of the housing half; and the nut further includes a sensor arc-shaped cam configured to cooperate with the sensor cam of the housing half, to prevent axial separation of the housing and sensor connector halves.

16. A connector assembly as defined in claim 12, wherein the detent is a deflectable finger positioned adjacent to a trailing edge of the cam of the housing connector half and the securement is a depression defined by the cam of the nut adjacent to a trailing edge thereof.

17. A connector assembly as defined in claim 12, wherein the cavity of the housing connector half is configured to provide a fluid-resistant seal with the sensor half, the sensor half having an O-ring mounted to contact the housing half within the cavity.

18. A connector assembly as defined in claim 12, wherein the bayonet nut is snap-fit to the housing connector half to prevent axial separation the nut and the housing connector half while allowing the nut to rotate between the open position and the closed position.

* * * * *